United States Patent [19]

Wark et al.

[11] Patent Number: 4,907,751

[45] Date of Patent: Mar. 13, 1990

[54] ROTATING THROAT FOR COAL PULVERIZER

[75] Inventors: Rickey E. Wark, Pontiac; James R. Cunningham, Royal Oak, both of Mich.

[73] Assignee: Sure Alloy Steel, Warren, Mich.

[21] Appl. No.: 251,776

[22] Filed: Oct. 3, 1988

[51] Int. Cl.[4] ..... B02C 15/04

[52] U.S. Cl. ..... 241/119

[58] Field of Search ..... 241/117-121, 241/300, 79.1

[56] References Cited

U.S. PATENT DOCUMENTS 4,605,174 8/1986 Maliszewski et al. ..... 241/119 X 4,752,037 6/1988 Farris et al. ..... 241/119 X

FOREIGN PATENT DOCUMENTS 587989 1/1978 U.S.S.R. ..... 241/119

*Primary Examiner*—Mark Rosenbaum

*Attorney, Agent, or Firm*—Krass & Young

[57] ABSTRACT

A rotating throat pulverizing mill has a soft steel vane wheel which rotates with the control bowl for classifying purposes. Wear-resistant vane liners slide onto the vanes to protect the upper surfaces thereof and are held in place, in part, by integral clips which underlie the vane plates and, in part, by wear-resistant cap plates which are welded to a flush upper flange of the vane wheel. Arcuate wear plates are also welded to the exposed surfaces of an air deflector outboard of and above the vane wheel. The vane wheel is preferably constructed in segments. A modified deflector assembly comprises a first portion having a base plate and spaced vertical ribs, which first portion is bolted to a lower deflector, and a box-like, wear-resistant cover assembly which seats on the ribs and is welded to the seat blocks by ways of access holes.

18 Claims, 5 Drawing Sheets

FIG. 3
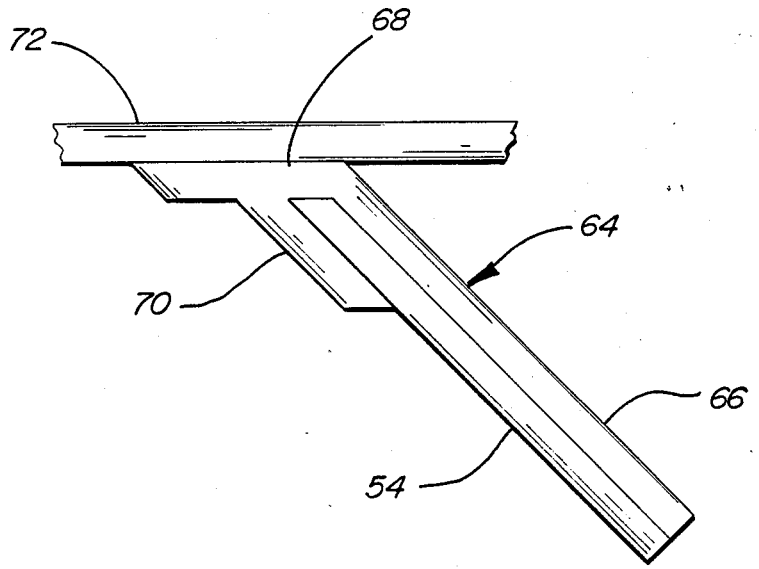
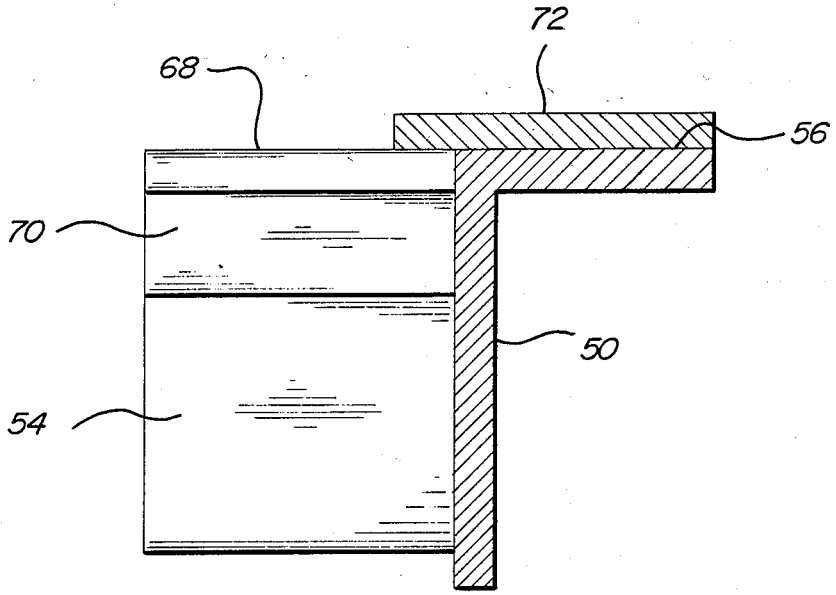
FIG. 4

ROTATING THROAT FOR COAL PULVERIZER

INTRODUCTION

This invention relates to rotating throat pulverizers and particularly to a system of wear-resistant components for increasing the useful life of the pulverizer by protecting certain components including the vanes of a rotating vane wheel.

BACKGROUND OF THE INVENTION

Pulverizing mills of the updraft type, often called "bowl mills," are commonly used to crush coarse material such as coal to prepare the coarse materials for subsequent operations. In the case of coal, coarse chunks or lumps of coal are pulverized into fines in preparation for use in the coal fired boilers of electric utility plants. An example of a rotating throat, updraft bowl mill can be found in U.S. Pat. No. 3,465,971 issued Sept. 9, 1969 to J. F. Dallenberg et al.

The materials, such as coal, which are pulverized or ground in the bowl mill are highly abrasive and tend to abrade or wear away the surfaces of the bowl mill which are contacted by them. The bowl mill, in addition to crushing or pulverizing the material, also performs a classifying or separating function in which heavy materials, such as pyrites, are separated out of the crushed coal and collected in a chamber beneath the crushing surface of the rotating bowl. The movement of the crushed coal and the pyrites over the surfaces of the rotating and non-rotating components also creates a critical wear problem.

The classifying or separating function in a rotating throat bowl mill is carried out at least in part by a vane wheel which comprises a plurality of circumferentially spaced and angularly pitched vanes which are secured to the rotating bowl at the outer periphery thereof and which rotate therewith. A forced air system in or associated with the mill urges air upwardly from the lower chamber through the vane wheel and thence upwardly through the housing of the bowl mill. The pyrites and heavier particles emerging radially outwardly from the crusher surface fall downwardly through the vane and contact the upper surfaces of the vane plates. The coal fines which are carried upwardly by the forced air tend to impact the lower angled surface of a deflector which lies peripherally adjacent and just above the vane wheel. It is known to use wear-resistant materials at these critical locations, see for example U.S. Pat. No. 4,605,174 issued Aug. 12, 1986 to Maliszewski et al. Stationary throat updraft pulverizers are also known. These differ essentially from rotating throat mills in that the vane wheel is attached to the outside mill wall and does not rotate with the crusher bowl.

SUMMARY OF THE INVENTION

The principal objective of the invention is to provide a wear-resistant vane wheel system for rotating throat pulverizing mills which is both effective and easily installed either as original equipment, replacement equipment or retrofit equipment, thereby to extend the useful life of the pulverizing mill and/or reduce effective down time by extending the operating periods between repairs. By retrofit, it is meant that components of the invention hereinafter described can be used in both rotating and stationary throat devices and can also be used to convert stationary throat mills to rotating throat mills.

According to one specific aspect of the invention, an improved vane plate liner is provided. The subject vane plate liner is preferably fabricated from a wear-resistant material such as a chromium carbide alloy and exhibits the integral combination of a primary plate which overlies the top of a soft steel vane plate, and a secondary plate, preferably trapezoidal in shape, joined at an acute angle to the primary plate, which overlies the top edge of the vane plate and which may be size-selected to produce optimum air flow characteristics through the openings between vanes; i.e., the size of the secondary plate, in part, determines the total open space and, therefore, the flow characteristics of air forced upwardly through the vane wheel.

According to a second aspect of the invention, wear-resistant vane liners of the type described above are easily installed and effectively retained in place by clip elements which are integral with the vane liners. Retention of the liners is completed by arcuate cap plates which are installed on and to the periphery of the vane wheel and which extend radially outwardly to partially overlie one or more of the secondary plates of the vane liners. A modified vane liner exhibits an integral outboard shield plate which protects the outer ring of the vane wheel.

In accordance with a third aspect of the invention, installation of the vane wheel as original equipment or on a retrofit basis is facilitated by means of a horizontal top flange on the inner ring of the vane wheel, which horizontal top flange overlies and is secured to the periphery of the bowl. Flush fasteners such as screws extend downwardly through the flange into the bowl and are arranged to terminate flush with the top of the flange so that no fastener components are exposed to wear as is the case in prior art devices. The flush arrangement of the fasteners relative to the horizontal mounting flange of the inner vane wheel ring permits the aforementioned arcuate cap plates to be installed directly over the flange and, as mentioned, partially over the vane liner secondary plates to hold them in place.

According to a fourth aspect of the invention, additional deflector protection and facilitated deflector installation is afforded by an upper deflector assembly. This assembly comprises a base plate carrying a plurality of spaced vertical ribs having seat blocks which mate with flanges on the back of deflector plates to hold the plates in place on the ribs as welding is carried out.

The vane wheel, the deflector and various wear plates are preferably constructed in segments which are joined by welding at the installation site.

BRIEF DESCRIPTION OF THE DRAWINGS

FIG. 3 is a side view of a vane liner installed on a vane plate;

FIG. 4 is an end view of the vane liner showing the overlapping relation of the cap plate therewith;

DETAILED DESCRIPTION OF THE ILLUSTRATIVE EMBODIMENTS

Figure 1:
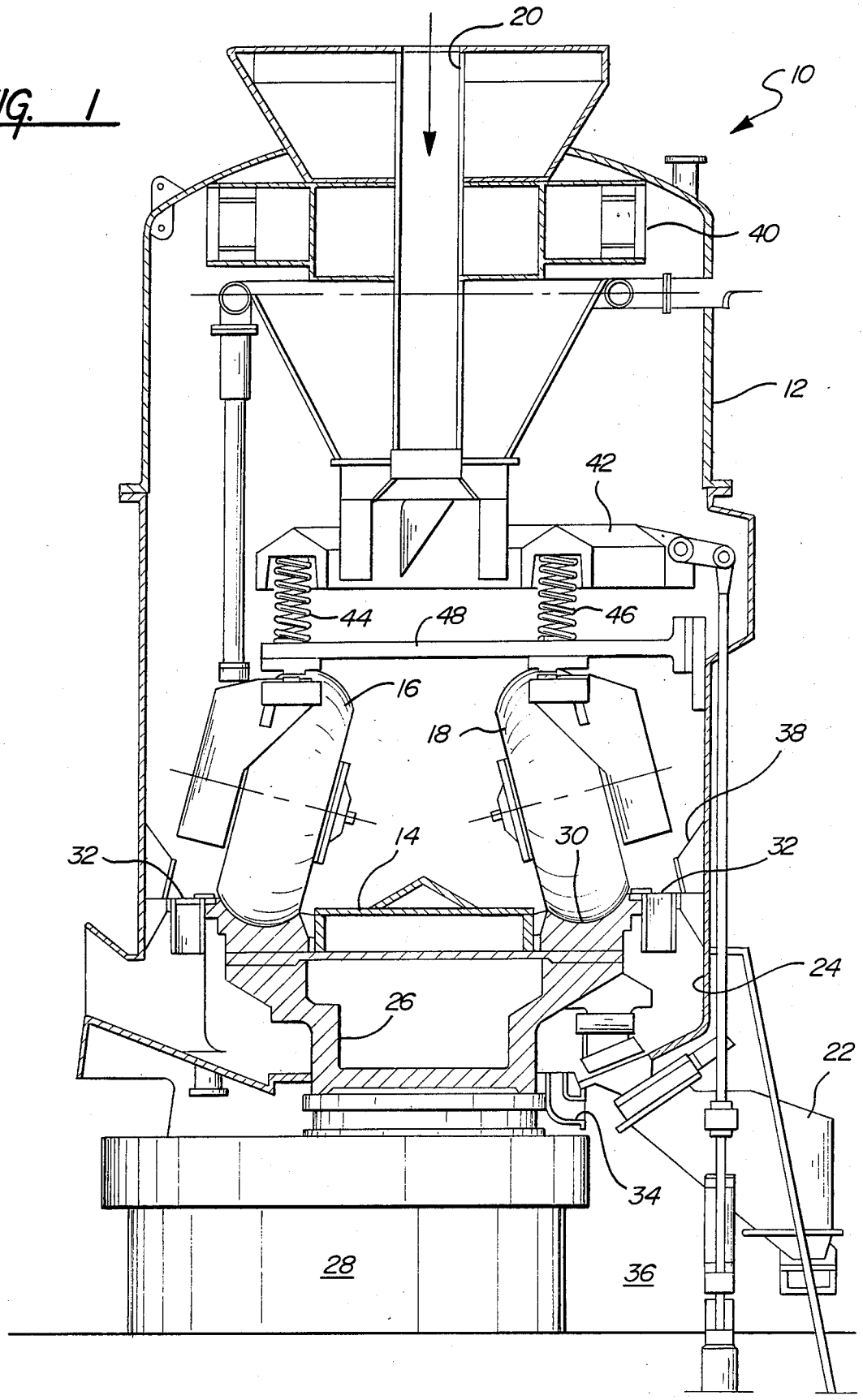
FIG. 1 is a cross-sectional view of one conventional rotating throat vertical pulverizing mill, disclosed herein primarily for environmental purposes but illustrating a use of the invention.

Referring to FIG. 1 there is shown a vertical bowl mill pulverizer 10 comprising an upright steel housing 12, a substantially horizontal rotating bowl 14 the upper surfaces of which coact with a plurality of rotating roller type crushers 16, 18 to pulverize coarse particulate material which is loaded into the housing 12 by means of a vertical inlet chute 20 aligned with the longitudinal vertical axis of the housing 12. Air is supplied to the housing 12 by means of a turbine and duct system 22 connected into a lower chamber 24 and forced to flow upwardly within the housing 12 around the outer periphery of the bowl 14.

Bowl 14 sits on a heavy steel turret which is driven so as to rotate about a vertical, longitudinal axis by a motor and suitable reduction gears within a housing 28.

In operation, the coarse particulate material is dropped through the chute 20 onto the center of the bowl 14 and moves by centrifugal force outwardly onto surface 30 which underlies the operating surfaces of the rollers 16 and 18 to effect the crushing function. Crushed material of varying size and density moves farther outwardly to the vicinity of a peripheral vane wheel 32, the inventive details of which are hereinafter described with reference to FIGS. 2–4, which rotates with the bowl 14 within the housing 12. Heavy, dense materials fall through the vane wheel 32 against the force of the uprushing air into the chamber 24, through chute 34 and into a lower chamber 36. Crushed fines are carried upwardly by the air current and are deflected inwardly by a deflector 38 secured to the inner surface of the housing 12 proximate and immediately above vane wheel 32. Thoroughly crushed fines are ultimately collected by apparatus 40 disposed in the upper reaches of the housing 12 in a known manner.

A heavy head structure 42 is secured within the housing by conventional apparatus and receives springs 44 and 46 to bear against a roller carrier structure 48 to apply pressure to the rollers 16 and 18, also in a known manner.

With the exception of the inventive details principally described hereinafter with reference to FIGS. 2–4, the overall structure of the bowl mill 10 shown in FIG. 1 is essentially conventional, can be found in the prior art, and will not be described in further detail in this patent. It should be noted, however, that there are other mill types with which the inventive components herein described are equally usable.

Figure 2:
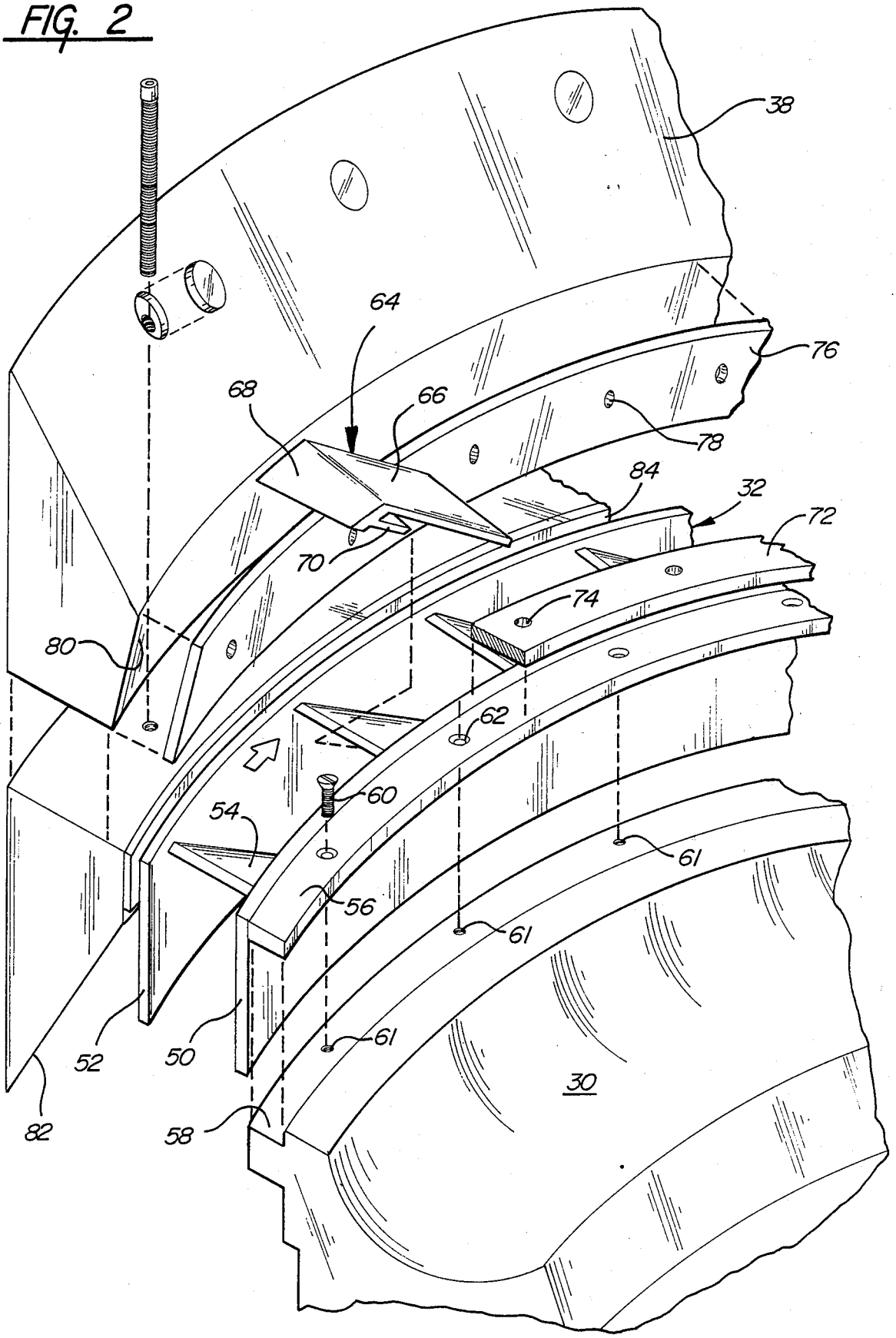
FIG. 2 is an exploded perspective view of a portion of the bowl mill of FIG. 1 illustrating the construction and installation method of a vane wheel constructed in accordance with the invention as well as three different wear-resistant protective components also constructed in accordance with the invention.

Looking to FIGS. 2–4, a representative portion of the bowl structure 30 is shown to operatively receive and carry for rotation therewith the soft steel vane wheel 32. Vane wheel 32 comprises the welded combination of a soft steel inner ring 50, a spaced, parallel hardened steel outer ring 52, and a plurality of circumferentially spaced, angularly pitched vane plates 54 which are welded between the rings 50 and 52 to hold them together. The vane plates 54 are spaced according to the overall size of the bowl mill 10 and the air output capacity of the mechanism 22 shown in FIG. 1. The inner vane wheel ring 50 is provided with an arcuate horizontal, inwardly projecting top flange or sill 56 which seats within a rectangular bevel 58 formed in the top and peripherally outermost surface of the crusher bowl structure 30. Flat and tapered head machine screws 60 seating in conical chamfers 62 in the sill 56 are threaded into tapped holes 61 in the bowl seat structure 30 to rigidly secure the vane wheel 32 to the bowl structure 30 without leaving any fastener components in an exposed condition above the surface of the sill 56 where the flow of abrasive material is extremely high.

The vane wheel 32 is preferably constructed in segments, each of which is joined to the bowl structure 30 in the manner described immediately above so as to ultimately make up a full circular vane wheel. Gaps between the segments may be necessary for dimensional tolerance purposes thereby to ensure that the segments will fit together under the worst case cumulative oversize condition. These gaps are readily filled by welding.

As indicated above, pyrites and other dense materials work their way outwardly over the active surface of structure 30 and fall downwardly through the openings of the vane wheel 32. To protect the vane plates 54 against wear, a plurality of vane liners 64 equal in number to the number of vane plates 54 are provided. Each vane liner 64 is made of a high hardness material such as chromium carbide alloy and exhibits the integral combination of a planar primary plate 66 of such size and proportion as to fully overlie the upper surface of each of the pitched vane plates 54. Each vane liner 64 further comprises a trapezoidal secondary plate 68 which lies in the overall horizontal plane of the vane wheel 32 when the liner 64 is properly installed. The size of the secondary plate 68 may be selected to produce, in part, optimum air flow through the vane wheel 32; i.e., for increased velocity air flow, the circumferential dimension of the secondary plate 68 is increased thereby to partially close the openings between each of the vane plates 54. For reduced air flow velocity, smaller secondary vane plates 68 are selected. Whatever the size, the secondary vane plate 68, in the installed condition, overlies the top edge of the vane plate 54.

To partially retain each of the vane liners 64 in the appropriate and operative overlying relationship with the associated vane plate 54, a retainer clip plate 70 extends downwardly from the secondary plate 68 in parallel spaced relationship with the primary plate 66, the gap or spacing between primary plate 66 and retainer clip 70 being approximately the same as the thickness of the vane plate 54. The arrangement of elements 66, 68 and 70 is such that the vane liners slide easily into place over the associated vane plates 54.

The protection and retention apparatus for the vane liners 64 and the sill 56 further comprises a plurality of wear-resistant high hardness cap plates 72 which are arcuate in configuration and which are welded by means of tapered plug weld holes 74 to the top surface of the sill 56 which is integral with the inner ring 50 of the vane plate 32. The radial dimension of the cap plates 72 is such as to fully cover the top surface of the sill 56 and to overlie approximately ½ inch to 1 inch of the secondary plate 68 of each of the vane liners 64. When welded to the sill 56, the cap plate 72 fully retains each of the associated vane liners 64 in operative position.

The cap plates 72 are preferably of such circumferential dimension as to cover 2, 3 or more vane liners 64.

Cap plates 72 also overlie part of each vane opening and, therefore, work along with plates 68 of the vane liners 64 to establish the overall vane opening size. Air flow rate is consequently a function of the sizes of both plates 68 and plates 72. Size selection and/or trimming is carried out to produce optimum results.

It is here to be noted that vanes 54 may themselves be made of hardened steel to eliminate the need for liners 64. In this arrangement cap plates 72 are still used to protect the sill 56 and to regulate air flow. Where no vane liners 64 are used, the cap plates 72 are necessarily of greater radial dimension to produce a given vane opening size and resulting air flow rate.

A representative portion of the deflector 38 is shown in FIG. 2 and, as will be remembered from FIG. 1, is located circumferentially outboard of the vane wheel 32. Arcuate wear-resistant plates 76 are welded by means of conical plug weld holes 78 to the upwardly and inwardly angled surface 80 of the deflector 38 to protect the deflector against wear due to the abrasive action of upbound coal fines carried in the air stream which passes through the vane wheel 32. A plurality of wear-resistant plates 76 forms a complete circle around the surface 80 of the deflector 38 and any gaps which are necessary for proper fit are filled with weld material. The lower portion 82 of deflector 38 is also protected by wear plates 84 which lie parallel and closely adjacent, but spaced from, the outer ring 52 of vane wheel 32. If used with a bowl mill in which the crusher rollers 16 and 18 have journal shafts which extend transversely out from the mill walls, the deflector structure shown may be of reduced height in the immediate area of the journal shafts.

The vane wheel 32 being at least partly soft, low carbon steel, is easily and economically fabricated. Vane pitch angles in the range of 45°, plus or minus 5°, are preferred and common in the industry. The wear-resistant components 64, 72, 76, 52, 84 and, where used, 54 preferably exhibit a hardness of about 1750 on the Knoops scale, a hardness which is readily achieved through the use of numerous commercially available alloys including chromium carbide alloys. The apparatus disclosed herein may be utilized in various combinations and in various configurations and may be installed as original equipment as well as retrofitted to existing bowl mills.

Figure 5:
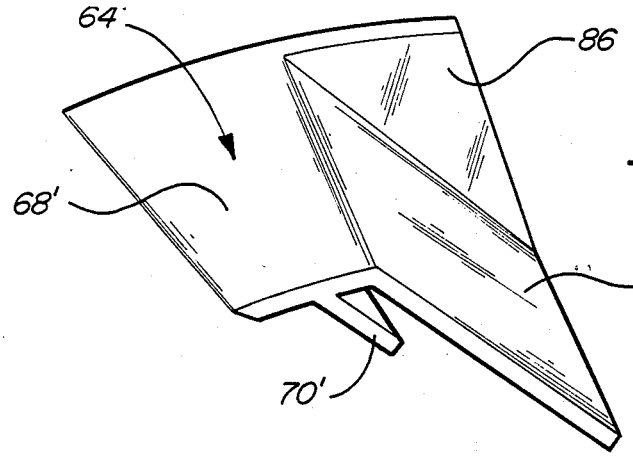
FIG. 5 is a perspective view of a modified vane liner having an outboard vane ring shield plate.

Referring now to FIG. 5, a modified vane liner 64' is shown. As was the case for the vane liner 64 shown in FIG. 3, vane liner 64' comprises a primary vane liner plate 66', an integral secondary or top plate 68' of rectangular or trapezoidal shape, and a clip 70' which, along with primary plate 66' embraces the underlying plate of the vane wheel 32. As thus far described, the vane liner 64' functions in exactly the same fashion as the vane liner 64 shown in FIG. 3. However, the modified vane liner 64' of FIG. 5 further exhibits an integral outboard vane ring shield plate 86 which, in the installed condition, lies parallel to and flush against a portion of the inside surface of the outer vane wheel ring 52 to protect that surface from wear. The centrifugal force which works the crushed material radially outwardly over the cap plate 72 also propels at least some of the material against the shield plate 86 and the shield plate 86 accordingly protects the inside surface of the vane ring 52.

Figure 6:
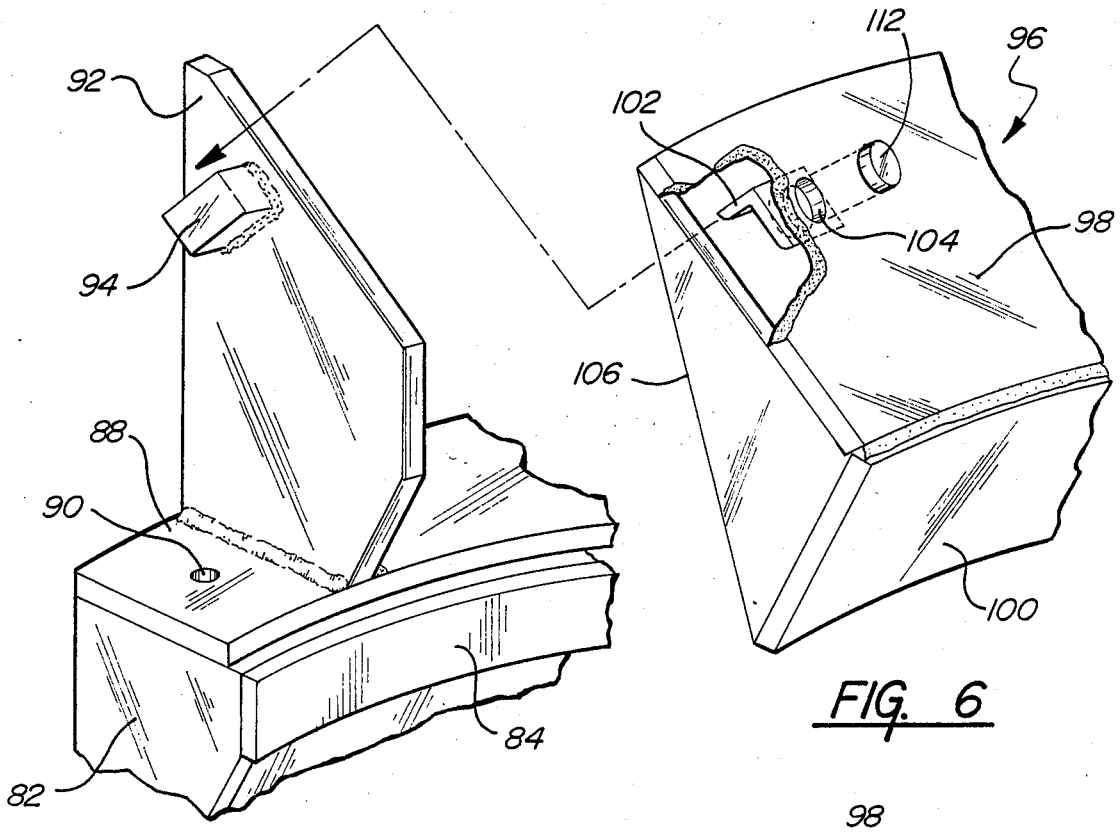
FIG. 6 is an exploded perspective view of an alternative deflector assembly.
Figure 7:
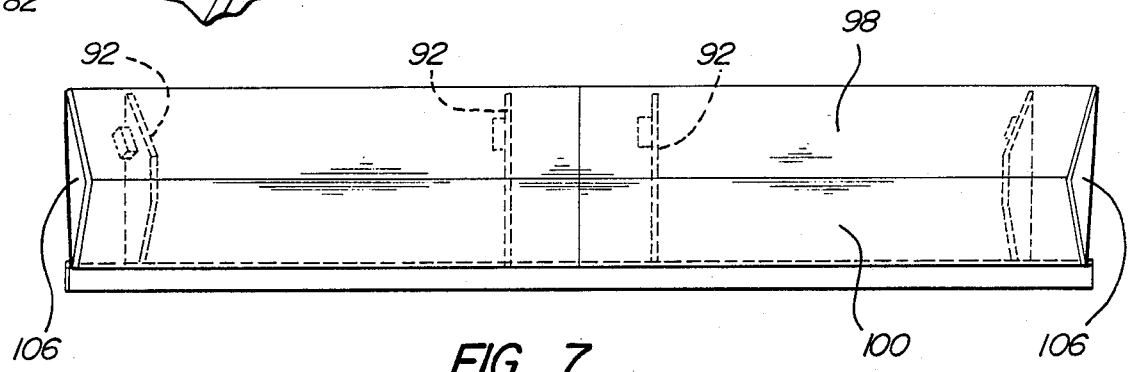
FIG. 7 is an assembly view of the alternative deflector assembly.
Figure 8:
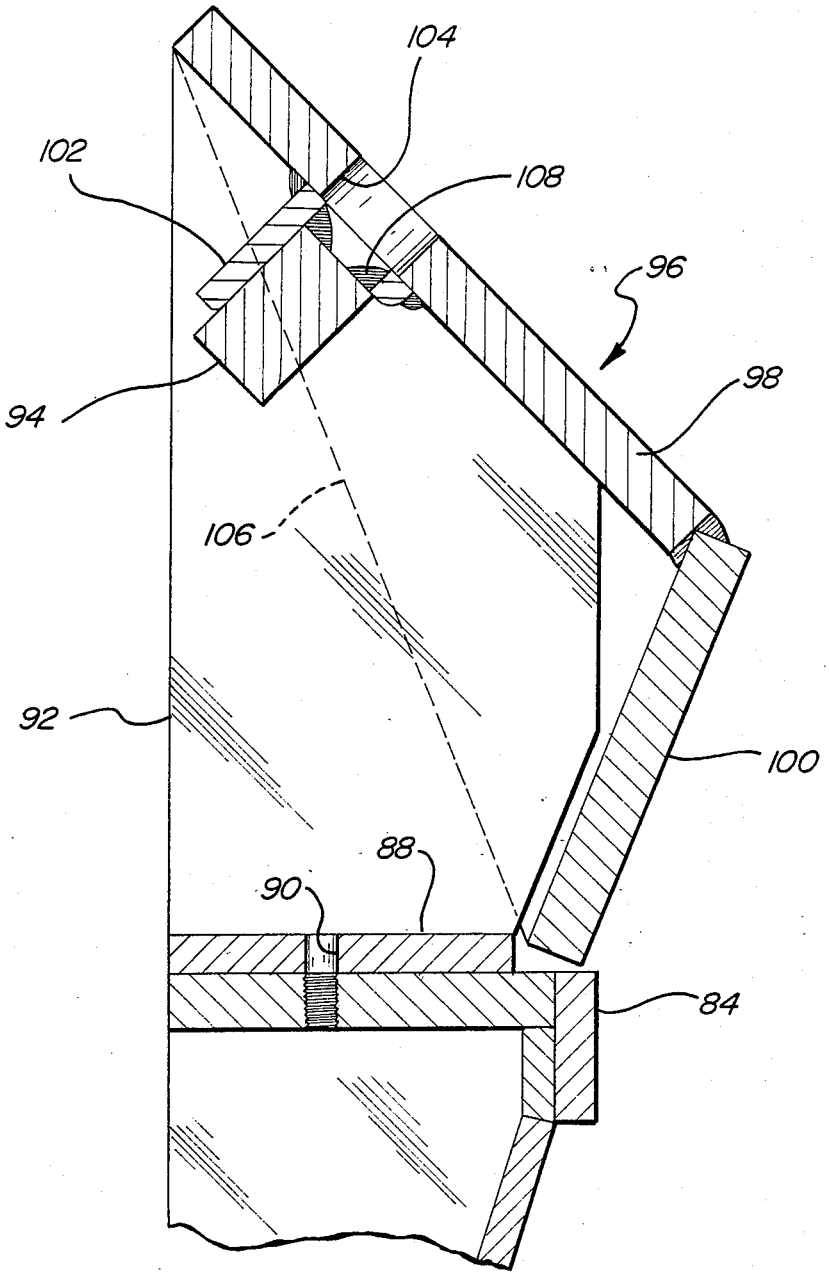
FIG. 8 is a sectional view of the alternative deflector assembly.

Referring now to FIGS. 6, 7 and 8, an alternative construction for the deflector 38 will be described. The primary advantages of the modified deflector assembly shown in FIGS. 6 and 7 are enhanced abrasion protection and simplified or facilitated installation.

As shown in FIGS. 6, 7 and 8, the lower portion 82 of the deflector assembly is constructed as was the case in FIG. 2 and also exhibits the series of arcuate wear plates 84. However, the upper deflector assembly comprises a base plate 88 to which at spaced intervals are welded a number of upright soft steel ribs 92 having a shape which essentially matches the profile of the upper deflector assembly 38 shown in FIG. 2. On at least one face of each of the ribs 92 a seat block 94 is welded in an angled position for purposes to be described. The combination of the base plate 88 and the vertical ribs 92 is preferably bolted to he lower deflector assembly 82 by means of holes 90 and bolts (not shown).

Thereafter, the upper deflector assembly is completed by way of segmented deflector boxes 96 which are fabricated from hardened steel, upper and lower face plates 98 and 100, respectively. These plates are preferably gusseted by plates 106 at periodic intervals to maintain shape. A plurality of flanges 102 are welded to the inside surface of the upper deflector plate 98. Flanges 102 are preferably made of conveniently available L-shaped angle iron.

During installation, the upper deflector assemblies or boxes 96 are placed on the ribs 92 with the flanges 102 seating directly on the seat blocks 94. Thereafter, the upper deflector boxes 96 are welded to the blocks 94 through access holes 104 which are subsequently filled by caps 112. This arrangement eliminates the need to fixture or hold the wear plates 76 of the FIG. 2 embodiment in place and also eliminate the need to make welds 78 in a upside-down partially vertical position where gravity tends to urge the weld material out of the hole.

As best shown in FIG. 8, the upper deflector boxes 96 are welded to the blocks 94 through access holes 104, the weld material which forms the bond being designated by reference numeral 108. After the weld is formed, the caps 112 may be held in place by epoxy, silicone or weld material.

As indicated above, the various aspects and components of the invention may be used in various combinations according to the particular needs of each individual installation.

We claim:

1. In a vertical pulverizing mill of the type having a housing, a rotating bowl within the housing having a substantially horizontal surface for receiving coarse material to be pulverized, crusher means coacting with the bowl surface for pulverizing the material, inlet means for placing coarse material on the bowl surface and a forced air source for directing air upwardly within the housing around the outer periphery of the bowl surface:

a vane wheel attached to the outer periphery of the bowl to rotate therewith and including a plurality of circumferentially spaced vane plates having essentially parallel upper and lower surfaces which are pitches at an angle to the horizontal, which plates define air flow openings therebetween;

a plurality of vane liners each including the integral combination of an essentially planar primary plate overlying the upper pitched surfaces of the associated vane plate, and a secondary plate which is horizontally disposed within the vane wheel and which overlies the top edge of the vane plate and extends into the air flow opening to affect the effective area thereof;

each of the vane liners being formed of a wear-resistant material; and means overlying at least a portion of each of said liners for securing said liners in place on said vane plates.

2. Apparatus as defined in claim 1 wherein each of the secondary plates is trapezoidal in shape.

3. Apparatus as defined in claim 1 wherein each of the vane liners includes a retainer member extending from the secondary plate parallel to the primary plate and underlying the vane plate when the liner is installed whereby the vane liner slides over and onto the vane plate for installation.

4. Apparatus as defined in claim 3 wherein said securing means includes a plurality of arcuate cap plates overlying radially inboard portions of the secondary plates, the cap plates overlying and being secured to the vane wheel to hold the vane liners in place.

5. Apparatus as defined in claim 4 wherein each of the cap plates overlies at least two vane liners and the plurality of cap plates forms a circle.

6. Apparatus as defined in claim 4 wherein each of the cap plates is made of wear-resistant material.

7. Apparatus as defined in claim 1 wherein the vane wheel is made in part of soft steel.

8. Apparatus as defined in claim 1 further including an air deflector mounted on the inner surface of the housing above and proximate the vane wheel to deflect air and particulate material flowing upwardly from the vane wheel, the deflector including a plurality of wear-resistant plates which collectively encircle the periphery of the vane wheel and which are upwardly and inwardly angled to deflect air passing upwardly through the vane wheel radially inwardly of the housing.

9. In a vertical pulverizing mill of the type having a housing, a rotating bowl within the housing and having a substantially horizontal surface for receiving coarse material to be pulverized, crusher means coacting with the bowl surface for pulverizing the material, and a forced air source for directing air upwardly around the periphery of the bowl;

a vane wheel adapted to be attached to the outer periphery of the bowl to rotate therewith and including an inner ring and a plurality of circumferentially spaced vane plates attached to the inner ring and pitched at an angle to the horizontal, the inner ring having a horizontal and radially inwardly projection flush top flange; and a plurality of fastener means extending vertically through said flush top flange and into said bowl for securing said vane wheel to said bowl, each of said fastener means terminating flush with the top of said flange;

wherein the vane wheel is fabricated in part of soft steel, the combination further comprising a plurality of wear-resistant vane plate liners overlying the upper surface of the vane plates, and a plurality of cap plates overlying and secured to the flush vane wheel flange and extending radially outwardly to overlie a portion of each of the vane liners thereby to at least assist in holding the vane liners to the vane plates.

10. In a vertical pulverizing mill of the type having a housing, a rotating bowl within the housing having a substantially horizontal surface for receiving coarse material to be pulverized, crusher means coacting with the bowl surface for pulverizing the material, inlet means for placing coarse material on the bowl surface:

a vane wheel attached to the outer periphery of the bowl to rotate therewith and including an inner ring, an outer ring spaced from the inner ring and a plurality of circumferentially spaced vane plates having parallel upper and lower surfaces which are essentially flat, said vane plates being attached to and between the inner and outer rings and pitched at an angle to the horizontal to form air flow openings therebetween; and a plurality of arcuate cap plates attached in a circle to and overlying the inner ring of the vane wheel and partially overlying the vane plates, each of the cap plates being formed of a wear-resistant material.

11. In a vertical pulverizing mill of the type having a housing, a rotating bowl within the housing having a substantially horizontal surface for receiving coarse material to be pulverized, crusher means coacting with the bowl surface for pulverizing the material, inlet means for placing coarse material on the bowl surface, a forced air source for directing air upwardly within the housing around the outer periphery of the bowl surface, and a vane wheel attached to the outer periphery of the bowl to rotate therewith and including a plurality of the bowl to rotate therewith and including a plurality of circumferentially spaced vane plates which are pitched at an angle to the horizontal;

a deflector assembly attached to the housing peripherally outboard of and spaced from the vane wheel and comprising a lower assembly, a base plate attached to the top of the lower assembly, a plurality of vertical ribs attached to and extending vertically upwardly from the base plate at circumferentially spaced intervals, a plurality of rearwardly opening box-like assemblies of wear-resistant, inwardly-angled plates;

means for seating said box assemblies on said ribs; and access means in each of said box assemblies for permitting the box assemblies to be welded to the ribs.

12. Apparatus as defined in claim 11 wherein the seating means comprises at least one seating block secured to a lateral surface of each of said ribs and a flange secured to an inner surface of each box assembly, said flange acting to rest on said seating block, a plate of each of said box assemblies having at least one access hole for welding of the box assemblies to the seating block; the box assemblies collectively forming a circle.

13. In a vertical pulverizing mill of the type having a housing, a rotating bowl within the housing, and having a receiving surface upon which coarse material to be pulverized may be placed, crusher means coacting with the bowl surface for pulverizing the material, inlet means for placing coarse material on the bowl surface;

a vane wheel attached to the outer periphery of the bowl to rotate therewith and including the unified combination of an inner ring, an outer ring spaced radially outwardly from and parallel to the inner ring, and a plurality of flat vane plates having parallel upper and lower plane surfaces attached to and between the inner and outer rings in circumferentially spaced relationship to form air flow openings therebetween, said vane plates having upper edges and being pitched at an angle to the horizontal;

said inner ring terminating at its upper extremity in a flat horizontal flange adapted to be flush mounted to the pulverizer bowl surface, said bowl having a flange receiving recess formed in the outer portion of the upper surface thereof for receiving said inner ring flange;

a plurality of vane liners having flat primary members adapted to slide into overlying contacting relationship with the upper flat surfaces of the vane plate and a secondary member joined to the primary member and overlying the top edge surface of the vane plate and extending into and affecting the area of the air flow opening;

each vane liner having a retainer element which extends into contacting relationship with the lower parallel surface of the vane plate; and a plurality of arcuate cap plates of wear-resistant material attached in a circular pattern to and overlying the flush flange of the vane wheel inner ring and extending into and overlying the air flow openings thereby to partially overlie the secondary plates of the vane liners and to secure the vane liners in position.

14. In a vertical pulverizing mill of the type having a housing, a rotating bowl within the housing having a substantially horizontal surface for receiving coarse material to be pulverized, crusher means coacting with the bowl surface for pulverizing the material, inlet means for placing coarse material on the bowl surface and a forced air source for directing air upwardly within the housing around the outer periphery of the bowl surface;

a vane wheel attached to the outer periphery of the bowl to rotate therewith and including a plurality of circumferentially spaced vane plates having essentially parallel upper and lower surfaces which are pitched at an angle to the horizontal, which plates define air flow openings therebetween; and a plurality of vane liners including the integral combination of an essentially planar primary plate overlying the upper pitched surfaces of the associated vane plate, and a secondary plate which is horizontally disposed within the vane wheel and which overlies the top edge of the vane plate and extends into the air flow opening to affect the effective area thereof;

each of the vane liners being formed of a wear-resistant material;

wherein each of the vane liners includes a retainer member extending from the secondary plate parallel to the primary plate and underlying the vane plate when the liner is installed whereby the vane liner slides over and onto the vane plate for installation;

wherein said apparatus further includes a plurality of arcuate cap plates overlying radially inboard portions of the secondary plates, the cap plates overlying and being secured to the vane wheel to hole the vane liners in place.

15. Apparatus as defined in claim 14 wherein each of the cap plates overlies at least two vane liners and the plurality of cap plates forms a circle.

16. Apparatus as defined in claim 14 wherein each of the cap plates is made of wear-resistant material.

17. Apparatus as defined in claim 14 wherein the vane wheel is made in part of soft steel.

18. Apparatus as defined in claim 14 further including an air deflector mounted on the inner surface of the housing above and proximate the vane wheel to deflect air and particulate material flowing upwardly from the vane wheel, the deflector including a plurality of wear-resistant plates which collectively encircle the periphery of the vane wheel and which are upwardly and inwardly angles to deflect air passing upwardly through the vane wheel radially inwardly of the housing.

* * * * *